US005586409A

United States Patent [19]

Jamieson

[11] Patent Number: 5,586,409

[45] Date of Patent: Dec. 24, 1996

[54] SAFETY VASES FOR UMBRELLA TABLES

[76] Inventor: Bruce W. Jamieson, 1361 Divine La., Tracy, Calif. 95376

[21] Appl. No.: 339,020

[22] Filed: Nov. 14, 1994

[51] Int. Cl.[6] ..... A01G 5/00; A47G 7/00

[52] U.S. Cl. ..... 47/41.01; 47/39; 47/41.1

[58] Field of Search ..... 47/41.1, 39 P, 47/39, 41.01, 41.11

[56] References Cited

U.S. PATENT DOCUMENTS

| | | | |
|---|---|---|---|
| 1,806,123 | 5/1931 | Smith | 47/39 P |
| 3,001,326 | 9/1961 | O'Brien et al. | 47/41.1 |
| 3,369,321 | 2/1968 | Blackistone, Jr. | 47/41.1 |
| 4,418,496 | 12/1983 | Koistinen . | |
| 4,631,859 | 12/1986 | Letter et al. | 47/41.1 |
| 4,821,454 | 4/1989 | Wilds | 47/41.01 |
| 5,322,254 | 6/1994 | Birkmeier | 47/41.1 |

FOREIGN PATENT DOCUMENTS

| | | | |
|---|---|---|---|
| 15845 | 7/1907 | United Kingdom | 47/41.1 |
| 310 | 1/1912 | United Kingdom | 47/41.1 |

*Primary Examiner*—Terry Lee Melius
*Assistant Examiner*—Joanne C. Downs
*Attorney, Agent, or Firm*—Schapp and Hatch

[57] ABSTRACT

An untippable safety vase for use in connection with umbrella tables is disclosed, which vase is comprised of a central, generally cylindrical receptacle portion adapted to fit loosely in the umbrella pole receiving aperture of an umbrella table, and a planar flange joined to and projecting outwardly from said central receptacle portion.

5 Claims, 2 Drawing Sheets

SAFETY VASES FOR UMBRELLA TABLES

BACKGROUND OF THE INVENTION

1. Field of the Invention

My present invention relates to vases, and more particularly to untippable safety vases for use in connection with umbrella tables.

2. Description of the Prior Art

Vases of many shapes and sizes have been well known in the prior art for many years.

It is well known to use vases for the display of cut flowers, the stems of the particular bunch of cut flowers to be displayed being contained in the vase, which is then partially or completely filled with water.

As is well known, some tall and slender vases of the prior art adapted for the display of "long-stemmed" flowers are subject to being easily tipped or upset, thereby discharging the water contained in the vase onto the adjacent tabletop and consequently wetting the associated tablecloth or items disposed on the table top, such as newspapers, books, and other items which are damaged by wetting.

This problem with prior art vases for "long-stemmed" flowers is particularly aggravated when the table upon which such a vase is disposed is subject to frequent precipitate displacement or jostling, as is the case with umbrella tables which are not provided with an umbrella table weight.

For this reason, certain vases of the prior art are provided with clips or clamps by which they may be affixed to their associated support structures. An example of such vases and their associated clips or clamps is disclosed in U.S. Pat. No. 4,418,496, issued to Arnold A. Koistinen on Dec. 6, 1983. The vase clip of Koistinen is adapted to engage the top edge portion of a church pew or bench, and does not address the problem of the upsetting of a vase disposed upon a planar, horizontal tabletop, adjacent the center thereof.

A copy of said U.S. Pat. No. 4,418,496 is being filed in the United States Patent and Trademark Office along with this patent application.

The term "prior art" as used herein or in any statement made by or for applicant means only that any document or thing referred to as prior art bears, directly or inferentially, a date which is earlier than the effective filing date hereof.

No representation is made that the Koistinen patent is part of the prior art, or that a search has been made, or that no more pertinent information exists.

SUMMARY OF THE INVENTION

Accordingly, it is an object of my present invention to provide safety vases which may be used in connection with conventional umbrella tables for the display of cut flowers, and especially "long-stemmed" cut flowers, without the risk of upsetting the vase and thus wetting the adjacent tabletop and damaging water-damageable articles disposed upon the tabletop or wetting the clothing of persons seated at the table.

Another object of my present invention is to provide untippable safety vases which are essentially invisible to persons seated at the table bearing the vase.

Yet another object of my present invention is to provide untippable safety vases which appear to be common vases when in use.

A further object of my present invention is to provide untippable safety vases which have the appearance of dishes, such as plant dishes or bonbon dishes, when in use, and which dishes may further appear to include a central, integral cut flower vase.

A yet further object of my present invention is to provide untippable safety vases which achieve one or more of the preceding objects and at the same time permit the automatic watering of soil contained in the dish portion while supplying water to the central vase portion.

Other objects of my present invention will in part be obvious, and will in part appear hereinafter.

My present invention, accordingly, comprises the apparatus embodying features of construction, combinations of elements, and arrangements of parts, all as exemplified in the following disclosure, and the scope of my present invention will be indicated in the claims appended hereto.

In accordance with a principal feature of my present invention an untippable safety vase for use in connection with an umbrella table is comprised of a generally cylindrical central receptacle portion and a flange portion extending radially outwardly from the mouth of said receptacle portion, the outside diameter of said central receptacle portion being less than the diameter of the central hole which extends through the top of said umbrella table.

In accordance with another principal feature of my present invention an untippable safety vase of a second preferred embodiment thereof is comprised of a generally cylindrical central receptacle portion and a flange which projects radially outwardly from a portion of the wall of said central receptacle portion remote from the mouth thereof.

In accordance with yet another principal feature of my present invention an untippable safety vase of a third preferred embodiment thereof is comprised of a generally cylindrical central receptacle portion, a discoid floor portion projecting radially outwardly from a portion of the wall of said central receptacle portion remote from the mouth thereof, and a cylindrical outerwall portion extending upwardly from the periphery of said floor portion.

In accordance with a further principal feature of my present invention an untippable safety vase of said third preferred embodiment of my present invention is provided with at least one aperture extending through the cylindrical wall of said central receptacle portion above said discoid floor portion.

For a fuller understanding of the nature and objects of my present invention, reference should be had to the following detailed description, taken in connection with the accompanying drawings.

DESCRIPTION OF THE PREFERRED EMBODIMENTS

Figure 1:
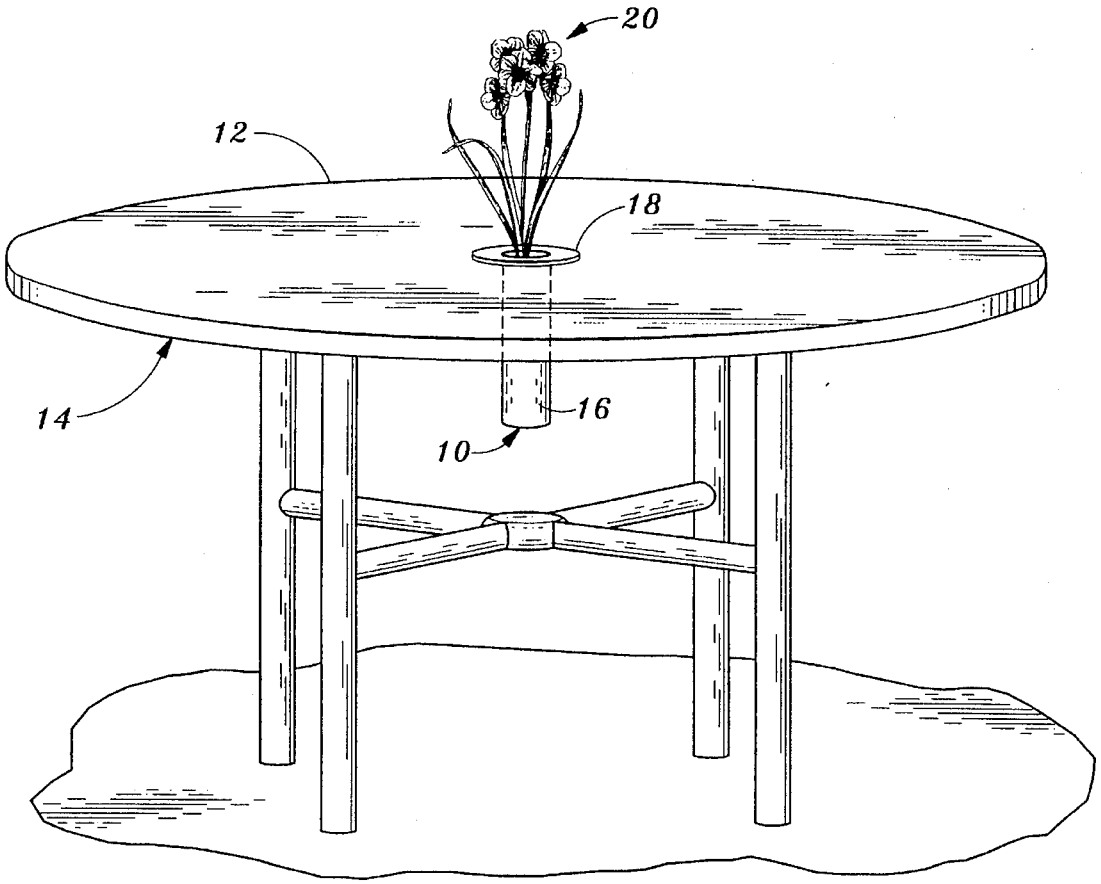
FIG. 1 is a perspective view of a conventional umbrella table bearing an untippable safety vase of the first preferred embodiment of my present invention.

Referring now to FIG. 1, there is shown a vase 10 of the first preferred embodiment of my present invention which is mounted in the central umbrella pole receiving aperture 12' of the tabletop 12 of a conventional umbrella table 14.

As further seen in FIG. 1, vase 10 is comprised of a cylindrical central receptacle portion 16 and a flange portion 18 which projects outwardly from the mouth of central receptacle portion 16.

As also seen in FIG. 1, the lower ends of the stems of a bunch of cut flowers 20 are contained in central receptacle portion 16, and pass through the central opening of flange portion 18, which surrounds the mouth of central receptacle portion 16.

Figure 2:
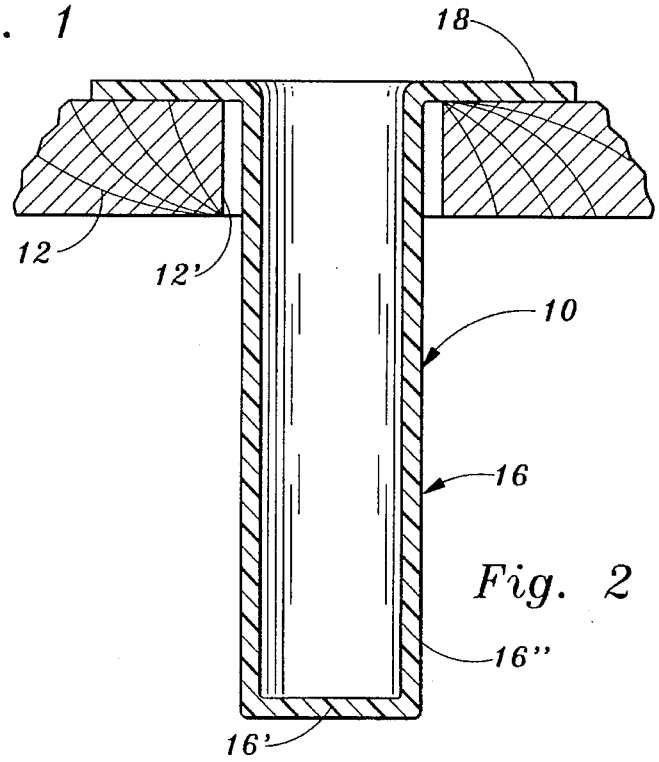
FIG. 2 is a vertical sectional view of an untippable safety vase of the first preferred embodiment of my present invention which is mounted in the central aperture in the tabletop of a conventional umbrella table (shown only in part)

Referring now to FIG. 2, it will be seen that safety vase 10 is comprised of a cylindrical wall 16", a floor 16' and a flange 18.

As also seen in FIG. 2 cylindrical wall 16", floor 16' and flange 18 are integrally formed as a single body of transparent plastic material, such as lucite.

It is to be understood, however, that my invention is not limited to such integrally formed constructions, nor to the use of transparent materials.

To the contrary, it is contemplated that in certain embodiments of my invention the central receptacle portion 16 (wall 16" and floor 16') may be integrally formed, while flange 18 is separately fabricated and subsequently affixed to receptacle portion 16.

Thus, it is to be understood that vase 10 of the first preferred embodiment of my invention may be formed as a single integral body, or may be formed from separate parts which are joined together after their fabrication, and that vase 10 may be formed from transparent or opaque material, in any desired color.

Figure 3:
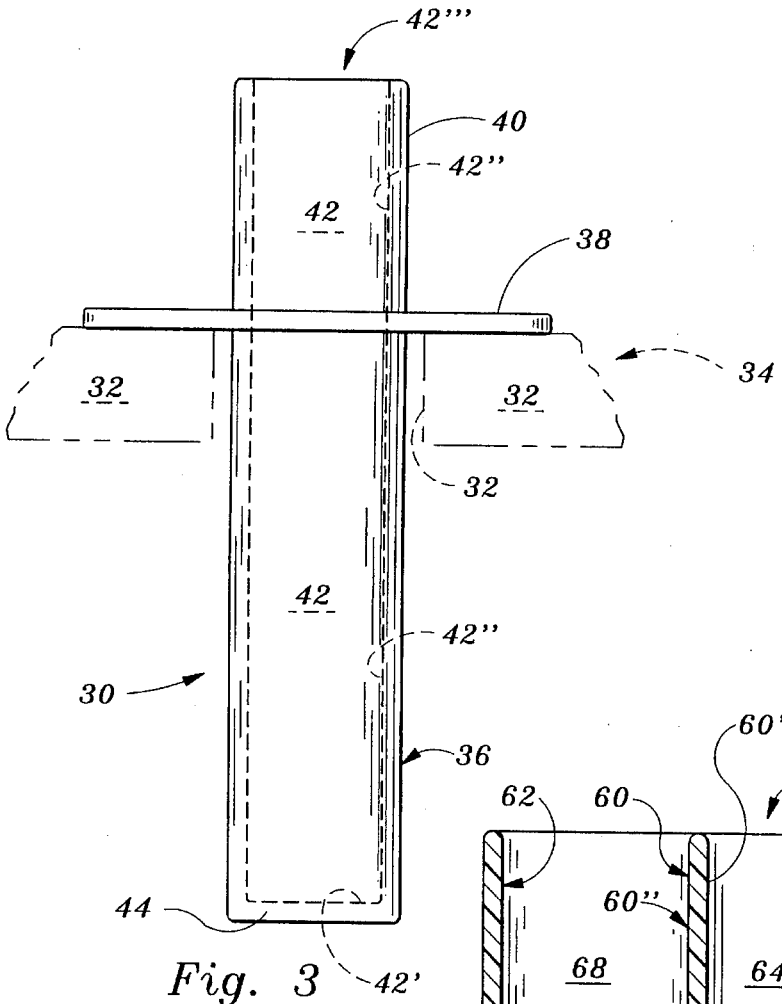
FIG. 3 is an elevational view of an untippable safety vase of the second preferred embodiment of my invention.

Referring now to FIG. 3, there is shown a safety vase 30 of the second preferred embodiment of my invention, which is operatively disposed in the umbrella pole receiving hole 32' in the tabletop 32 of an umbrella table 34.

As will now to evident to those having ordinary skill in the art, informed by the present disclosure, vase 30 is comprised of a central receptacle portion 36, a flange portion 38 and an extension portion 40.

It is to be understood that the interior chamber 42 of vase 30 is defined by the inner face 42' of floor 44 and a continuous cylindrical surface 42" which extends from floor inner face 42' to the open mouth 42''' at the upper end of extension portion 40.

It is further to be understood that while extension portion 40 is shown as a simple hollow cylindrical member in FIG. 3, other embodiments of my present invention may be generally configured as shown in FIG. 3 but have extension portions so shaped as to resemble conventional vases, e.g., tapered outwardly and upwardly, fluted, etc.

It is yet further to be understood that in such embodiments an inner floor or stop may be provided so that only extension portion 40 can receive flower stems.

It is also to be noted that vase 30, like vase 10, may be opaque or transparent, may be integral or fabricated from a plurality of separate parts which are later joined together, may be colored as desired, and may be fabricated from many different materials.

As also seen in FIG. 3, the outside diameter of central receptacle portion 36 will be such that central receptacle portion 36 is loose-fittingly received in the umbrella pole receiving aperture 32' of tabletop 32.

As was discovered during the development of products embodying the present invention, the diameters of the umbrella pole receiving apertures of a large percentage of umbrella tables fall within a small range of variation, which range is such that a standard central receptacle portion diameter can be selected so that a vase with the standard central receptacle portion diameter will fit loosely in the umbrella pole receiving aperture of the majority of umbrella tables.

Figure 4:
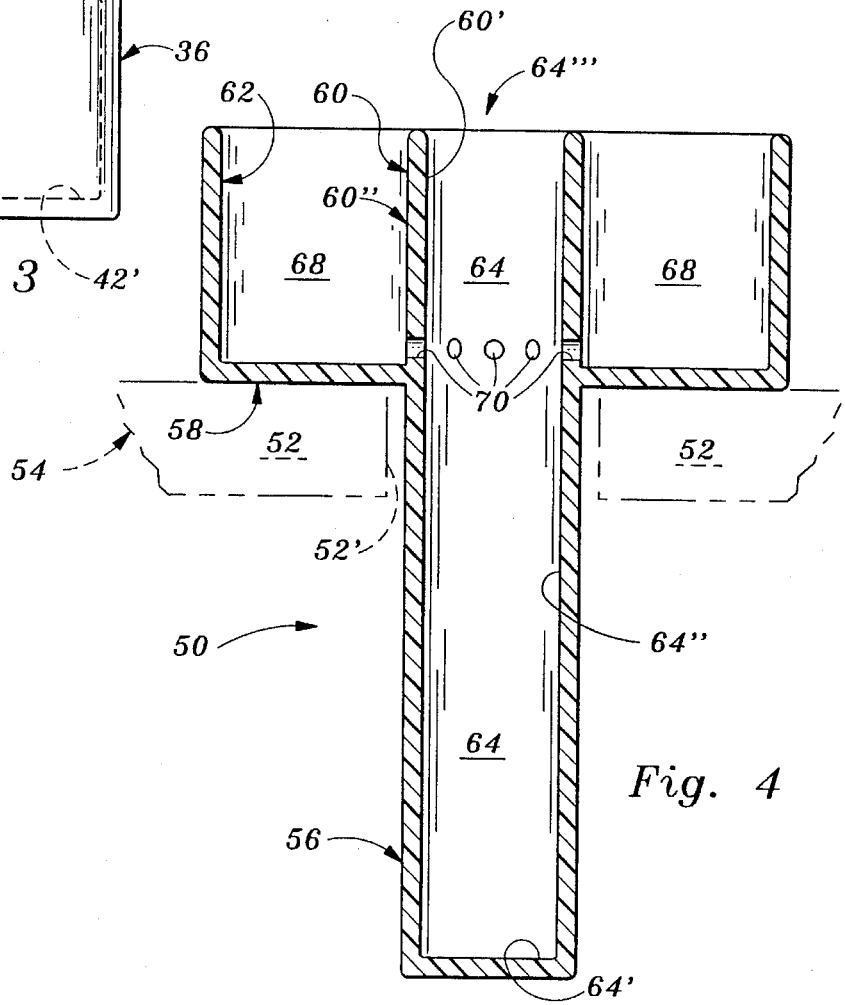
FIG. 4 is a vertical sectional view of an untippable safety vase of the third preferred embodiment of my present invention.

Referring now to FIG. 4, there is shown a safety vase 50 of the third preferred embodiment of my present invention.

As seen in FIG. 4, vase 50 is disposed in umbrella pole receiving aperture 52' which passes completely through tabletop 52 of a conventional umbrella table 54.

As will now be evident to those having ordinary skill in the art, informed by the present disclosure, vase 50 is comprised of a central receptacle portion 56, a planar flange portion 58, an extension portion 60 and an outer wall portion 62.

In vase 50 of the third preferred embodiment of my invention central receptacle portion 56 is substantially like receptacle portion 36 of the second preferred embodiment (FIG. 3).

Similarly, flange or floor portion 58 of vase 50 is substantially like flange 38 of vase 30 of the second preferred embodiment of the present invention, as shown in FIG. 3.

Also, extension portion 60 of vase 50 (FIG. 4) is substantially like extension portion 40 of vase 30 of the first preferred embodiment of the present invention, as shown in FIG. 3.

Comparing FIGS. 3 and 4, it will be seen that vase 50 of FIG. 4 is provided with an outer wall portion 62 the lower edge of which is affixed to the outer edge of flange portion 58.

As further seen in FIG. 4, the single central cavity 64 of vase 50 is defined by floor 64', the inner face 64" of receptacle portion 56, and the inner face 60' of extension portion 60, and extends from floor 64' to the mouth 64''' of vase 50.

As will also be seen in FIG. 4, a toroidal cavity 68 surrounds central cavity 64, and is defined by the outer wall 60" of extension portion 60, the upper surface of flange portion 58, and the inner surface of outer wall portion 62.

In accordance with another principal feature of the third preferred embodiment of the present invention, as seen in FIG. 4, a plurality of apertures 70 provide fluid communication between central cavity 64 and toroidal cavity 68 of vase 50, whereby water poured into central cavity 64, around the stems of the cut flowers disposed in central cavity 64, can migrate into toroidal cavity 68, thereby to maintain the moisture of potting soil contained in toroidal cavity 68, in which decorative plants are planted.

It is to be understood that while vase 50 is shown in FIG. 4 as a single, unitary member, vase 58 can as well, within the scope of the present invention, be fabricated from a plurality of separately formed parts.

It is also to be understood that while vase 50 is shown in FIG. 4 as fabricated from transparent material, it lies within the scope of the present invention to fabricate vase 50 from any desired or economically available material, such as plastic or metal, in any desired color.

It will thus be seen that the objects set forth above, among those made apparent from the preceding description, are efficiently attained, and since certain changes may be made in the above constructions without departing from the scope of my present invention, it is intended that all matter contained in the above description or shown in the accompanying drawings shall be interpreted as illustrative only, and not in a limiting sense.

It is also to be understood that the following claims are intended to cover all of the generic and specific features of my invention hereindescribed, and all statements of the scope of my invention which, as a matter of language, might be said to fall therebetween.

What is claimed is:

1. A safety vase for use in combination with an umbrella table the top of which is provided with an aperture for receiving an umbrella pole, comprising:

a water-tight receptacle portion having an outer wall which is symmetrical about a longitudinal axis, has an open end and a closed end, the maximum dimension of said receptacle portion transverse to said axis being less than the diameter of said aperture in said table top; and flange means extending outwardly from said outer wall of said receptacle portion, the diameter of the smallest cylinder coaxial with said longitudinal axis which is capable of containing the entirety of said flange means being greater than the diameter of said aperture in said table top, whereby a part of said receptacle portion adjacent said flange means is maintained in said aperture in said table top when at least a part of the lower face of said flange means bears against the upper face of said table top.

2. A safety vase as claimed in claim 1 in which said flange means extends outwardly from said open end of said receptacle portion.

3. A safety vase as claimed in claim 1 in which said flange means extends outwardly from a part of said outer wall remote from said open end of said receptacle portion.

4. A safety vase as claimed in claim 3, further comprising a continuous secondary wall portion coaxial with said receptacle portion and projecting from the periphery of said flange means toward said open end of said receptacle portion, and defining with said flange means and a part of said outer wall of said receptacle portion adjacent said open end a toroidal receptacle.

5. A safety vase as claimed in claim 4, further comprising at least one aperture in said outer wall of said receptacle portion, said at least one aperture communicating between the interior of said receptacle portion and the interior of said toroidal receptacle.

* * * * *